United States Patent [19]

Lewis

[11] Patent Number: 4,662,577

[45] Date of Patent: May 5, 1987

[54] TOILET TISSUE DISPENSER

[76] Inventor: Thomas Lewis, 917 Locust, Garberville, Calif. 95440

[21] Appl. No.: 347,352

[22] Filed: Feb. 9, 1982

[51] Int. Cl.[4] ..... B65H 16/04

[52] U.S. Cl. ..... 242/55.3; 242/55.53

[58] Field of Search ..... 242/55.2, 55.3, 55.53, 242/55.42; 211/16, 47; 312/38–40; 225/34, 41, 46

[56] References Cited

U.S. PATENT DOCUMENTS

| | | | |
|---|---|---|---|
| 2,571,321 | 10/1951 | Wettley | 242/55.2 |
| 3,168,258 | 2/1965 | Schwartz | 242/55.42 |
| 4,363,454 | 12/1982 | Mohar | 242/55.53 |

*Primary Examiner*—John M. Jillions

*Attorney, Agent, or Firm*—Harvey B. Jacobson

[57] ABSTRACT

A toilet tissue dispenser having an automatic locking device for preventing theft of toilet tissue rolls, in which the dispenser is of substantial construction capable of having full rolls of toilet tissue inserted from the top and contained securely therein by a lid cover locked in place, and when a new tissue roll is needed for the tissue dispensing portion of the dispenser, a pivot mechanism is swung by a handle through a 90° arc for positioning a spindle in axial alignment with a lower one of several tissue rolls which is dropped in place thereon and the received dispensing tissue roll is pivoted along with the pivot mechanism back to its initial horizontal position, so that the tissues are easily dispensed therefrom. A protector shield is provided for an ejector mechanism useful in dislodging an empty core of the tissue roll transverse of the toilet tissue dispenser. When the pivot mechanism and a full roll of tissue is in horizontal position, a locking plunger or pin becomes aligned with and enters a hole in the back of the dispenser for locking the pivot mechanism so it will remain locked until a spring biased ejector plate has ejected the core of the depleted roll of tissue with movement of the ejector plate retracting the plunger to enable movement of the pivot mechanism to a position to receive a full roll of tissue.

10 Claims, 8 Drawing Figures

66
70
3
10
24
14
26
12
18
102
38
24
120
90
92
16
3

12
14
40
38
92
120

16
114
116
124
106
92
104
112
96
108
98
110
111
32
90
38

64
66
4
64
62
62
16
58
52
18
20
22
56
50
30
104
5
5
106
102
86
38
40
84
88
34
90
7
7
96
32
4

TOILET TISSUE DISPENSER

BACKGROUND OF THE INVENTION

1. Field of the Invention

The present invention relates to a toilet tissue dispenser provided for horizontally orienting a vertically aligned lower tissue roll of a stacked array by receiving the next usable roll onto a vertical spindle and which is then turned on a horizontal pivot to orient the spindle and tissue roll in horizontal position. A locking lid cover secures the rolls of toilet tissue within the assembly for subsequent dispensing.

2. Description of the Prior Art

Toilet tissue dispensers have long been known to be subject to breakdown because of the number of various moving parts. Other tissue dispensers are known that do not provide for the toilet tissue rolls to be secure from theft, misappropriation, or extensive misuses. Various structures have been provided seeking constructing of an automatic dispensing and locking arrangement and without having an excessive number of moving parts.

Various U.S. patents are known relating to paper roll and toilet tissue holder and dispenser apparatus and these are listed as follows:

U.S. Pat. Nos. 2,794,604—June 4, 1957—Jacomaro; 2,839,346—June 17, 1958—Lawalin; 3,039,709—June 19, 1962—Bolger; 3,266,742—Aug. 16, 1955—Pena; 3,986,677—Oct. 19, 1976—Ootaki et al; 3,809,448—May 7, 1974—Rakaska; 3,865,295—Feb. 11, 1975—Okamura; 4,034,924—July 12, 1977—Carlisle; 4,098,469—July 4, 1978—McCarthy; 4,108,389—Aug. 22, 1978—Womack.

The patent to Pena, U.S. Pat. No. 3,266,742, discloses a container, a separator crank arm, a spindle and a stacked array of horizontally oriented toilet tissue rolls. The other patents are of more general insterest, but none of these prior art patents discloses orienting a stacked array of rolls of toilet paper in a vertical alignment, receiving the next usable roll onto a spindle which is rotated about a horizontal pivot to orient the spindle vertically for receiving a tissue roll and then return the tissue roll and spindle into a horizontal position, and further providing for a flipper arm to dispense an empty tissue roll core from a toilet tissue dispenser. These patents have no bearing on the patentability of any claim of the invention.

SUMMARY OF THE INVENTION

An object and advantage of the present invention is to provide a new toilet tissue dispenser having security in structure and dispensing of toilet tissues, having very few moving parts and having less cause for breakdown, disrepair and maintenance.

Another object of the invention is to provide for an automatic locking device for preventing theft of toilet tissue rolls and for eliminating complicated, extended and detailed crank mechanisms and the like.

A further object of the present invention is to provide a solid and compact toilet tissue dispenser construction for securing therein a series of toilet tissue rolls vertically aligned along their axis and providing a pivot structure for receiving a lower one of the tissue rolls which may then be pivoted 90° into horizontal position for conventional dispensing of the toilet tissue.

A still further and additional object of the present invention is to provide a lid cover that provides secure use and operation of the toilet tissue dispenser and for providing an attractive and pleasing appearance to the toilet tissue dispenser.

Yet another object of the invention is to provide a toilet tissue dispenser in the form of a cabinet receiving a stack of tissue rolls having the center hollow core oriented vertically with a pivotal tissue roll holder receiving the lowermost roll and pivoting it to a horizontal position for conventional dispensing with the holder being locked automatically in horizontal position and, when empty, the hollow core will be automatically ejected and the holder unlocked to enable pivotal movement to receive a full roll of tissue from the bottom of the stack.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
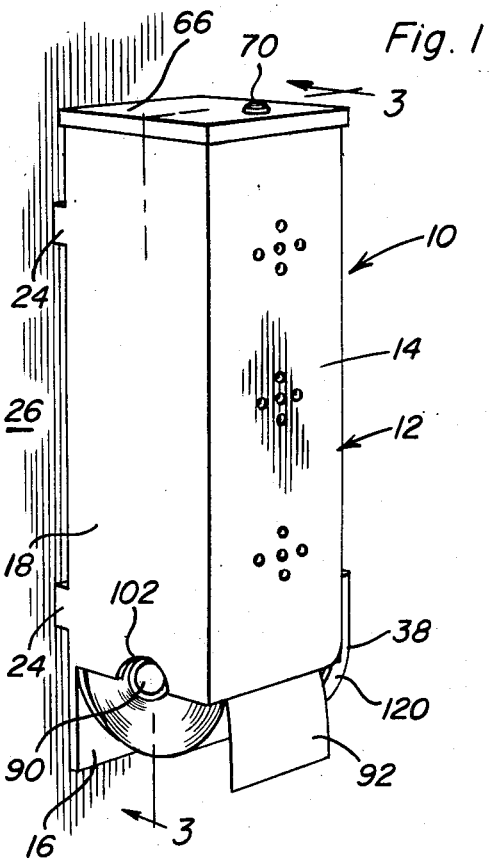
FIG. 1 is a perspective view of the toilet tissue dispenser according to the invention.
Figure 2:
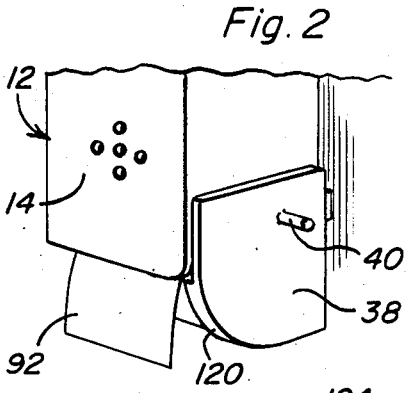
FIG. 2 is a fragmentary perspective view taken from the right lower side of the toilet tissue dispenser.

Referring now to the drawings, there is shown a toilet tissue dispenser 10 in the form of a cabinet 12 having a front wall 14, rear wall 16, a left side wall 18 and a right side wall 20 forming a chute 22. The cabinet 12 is provided with mounting bars 24 disposed in spatial relation along the outside surface of the rear wall 16 for engaging a bathroom wall 26 shown in FIGS. 1 and 4.

Figure 4:
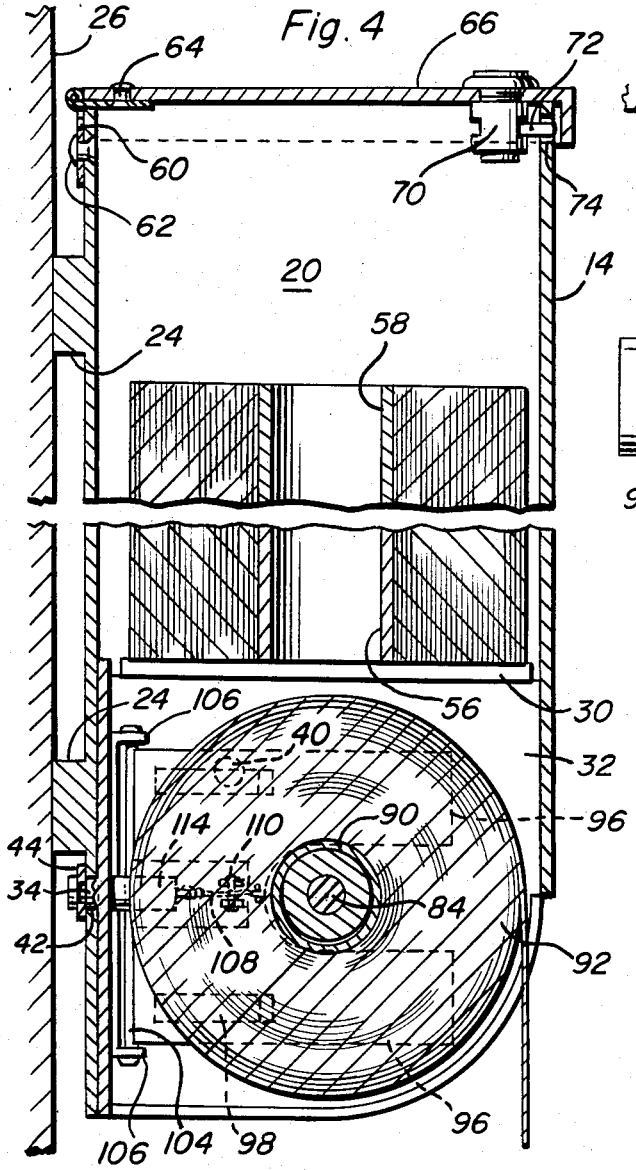
FIG. 4 is a sectional view taken along line 4—4 of FIG. 3.
Figure 5:
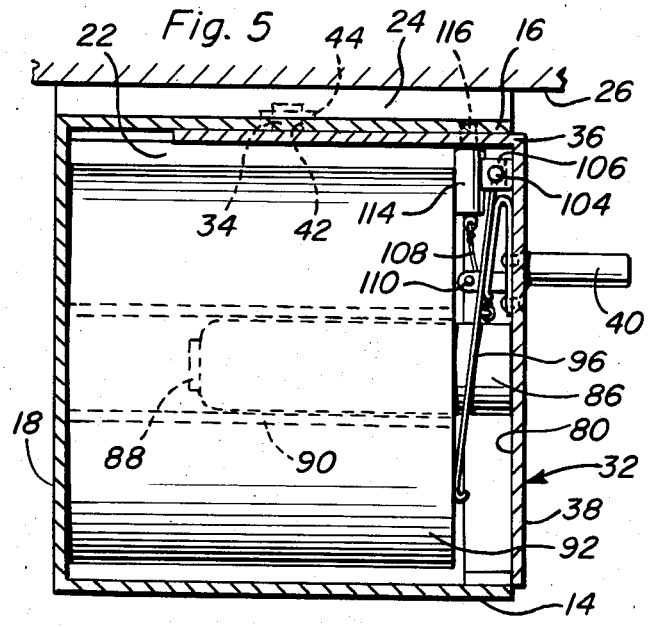
FIG. 5 is a sectional view taken along line 5—5 of FIG. 3.

The chute 22 within the cabinet 12 is provided with an inwardly extending plate or flange 30 mounted on an angle plate 32 having a pivot member 34 extending from one of the plates 36 of the angle plate 32 while the other plate 38 of the angle plate 32 provides a base for the flange 30 as well as support for an exteriorly extending handle 40. The pivot member 34 is retained in an aperture 42 in rear wall 16 by a fastener 44 as shown in FIGS. 4 and 5, so that the angle plate 32 is free to move about the pivot member 34 as turned by the handle 40.

Figure 3:
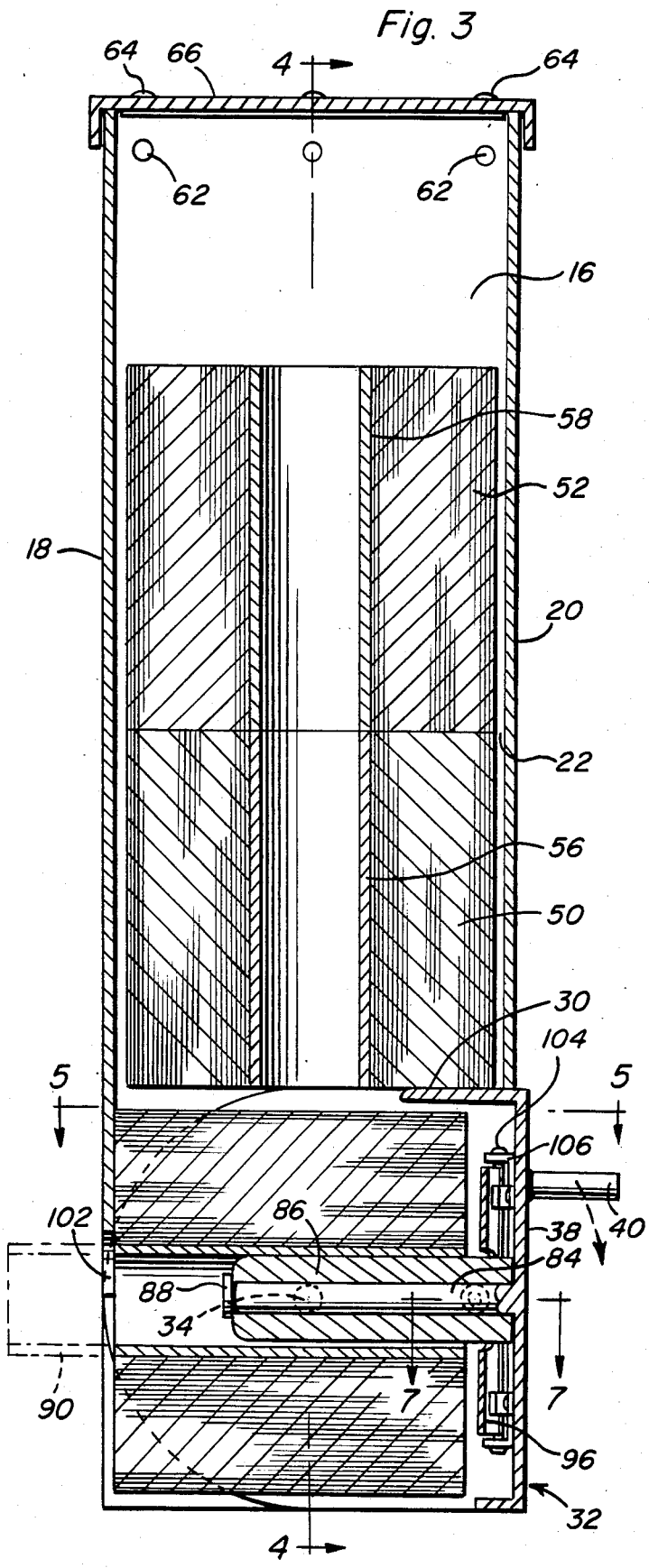
FIG. 3 is a sectional view, on an enlarged scale, taken along line 3—3 of FIG. 1.

Resting upon the flange 30 are a series of toilet tissue rolls 50, 52 which include a paper core 56, 58 on which are mounted toilet tissue sheets in a spiral manner as is well known in the art. The lowest tissue roll 50 rests upon the flange 30, such as shown in FIGS. 3 and 4. The upper end of the chute 22 is provided with a piano hinge or other hinge 60 secured to the rear wall 16 by rivets or fastener members 62 engaging the rear wall 16 while similar fastener members 64 secure the hinge to a top cover or lid 66 allowing it to open and close the upper end of the chute 22. A front edge of the cover 66 is provided with a lock arrangement 70 shown in FIGS. 1 and 4 including a key receiving aperture (not shown) for turning the lock so that a lock projection 72 engages a keeper slot 74 and when the projection 72 is received in the slot 74, the cover 66 is lockingly engaged upon the cabinet as shown.

The angle plate 32 such as shown in FIGS. 2–6 and 8 extends in generally perpendicular relationship to the bathroom wall 26. Mounted from an interior surface 80 of the plate 38 is a spindle 84 which rotatably supports a roller 86 which is held onto the spindle by a fastener 88. The roller is dimensioned to receive a tissue roll core 90, similar in construction and configuration to the cores 56, 58 described above and which, as shown in FIGS. 4 and 5, are provided to contain rolls of toilet tissue sheets 92.

Figure 7:
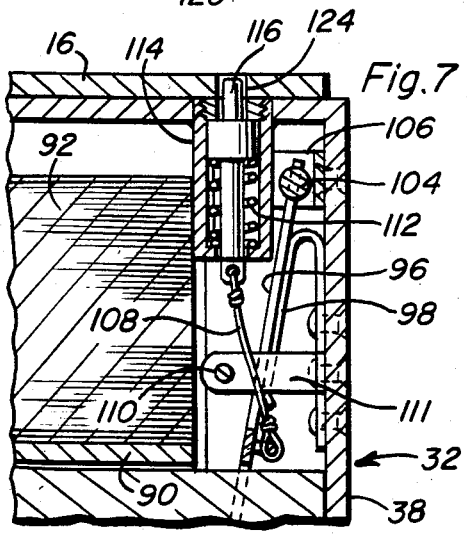
FIG. 7 is a sectional view, on an enlarged scale, taken along line 7—7 of FIG. 3.
Figure 6:
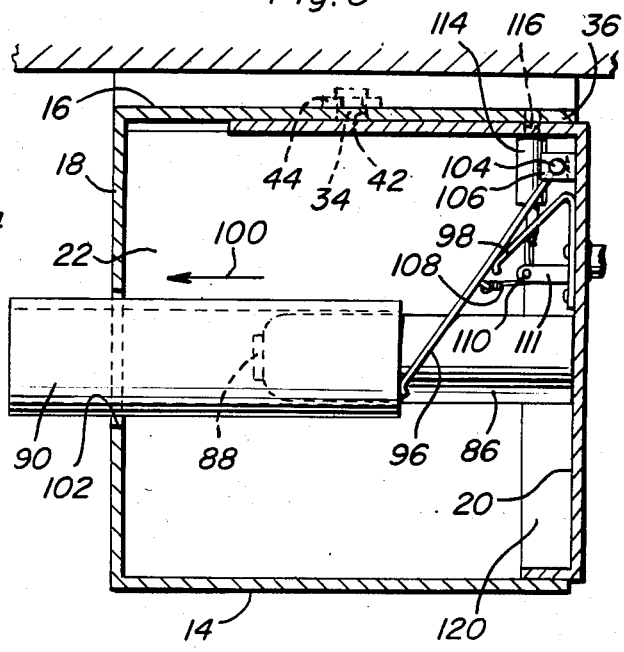
FIG. 6 is a view similar to FIG. 5, but in which the tissue roll core is in the process of being ejected by a flipper member.
Figure 8:
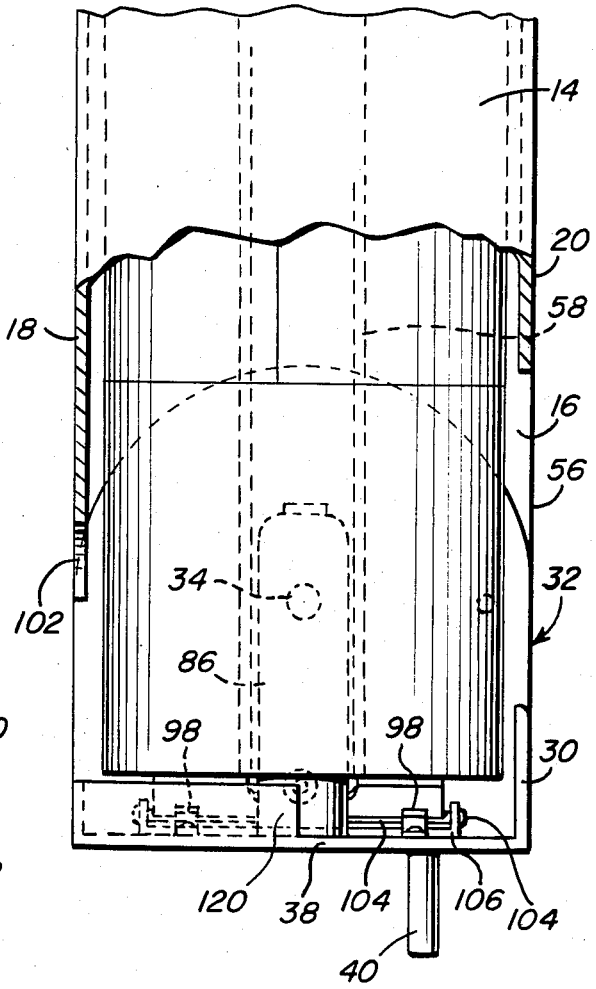
FIG. 8 is a fragmentary front elevational view partly in section and showing the manner in which the holder is swung through a 90° arc for receiving a full tissue roll.

When the tissue sheets 92 are depleted from the core 90, as is illustratively shown in FIG. 6, a tensioned flipper member or ejector plate 96 urged by the bias of a pair of U-shaped leaf springs 98 causes the core 90 to move leftward illustrated in FIG. 6 by the arrow 100 so that the core 90 is projected through a concave notch or recess 102 in the wall 18 as shown in FIGS. 1, 6 and 8 and the core is thereby removed and displaced from the cabinet 12. This action of the flipper member 96 can occur only when the core is substantially empty since tissue wound on the core will engage the inner surface of the wall 18 and precludes the roll from being ejected. The flipper member 96 is pivotally mounted by pivot rod 104 secured to the edge of the flipper member and engaging flipper member support brackets 106 mounted on plate 38. To provide for automatic locking and unlocking the holder, there is provided a plunger or lock pin 116 alignable with and received in a keeper aperture 124 in wall 16. The plunger is reciprocally mounted in guide sleeve 114 rigid with plate 36 and compression spring 112 biases plunger 116 outwardly toward locking position. The inner end of the plunger 116 has one end of a flexible cord or cable 108 attached thereto with the other end of the cord 108 being attached to the flipper member or ejector plate 96 at a point remote from the pivot rod 104. The intermediate portion of the cord 108 extends inwardly of a transverse bar 110 supported in spaced relation to plate 38 by brackets 111. When the flipper member 96 is engaged by a roll of tissue and disposed in its inward position, the cord 108 is generally straight but not taut and the spring 112 biases the plunger outwardly so that it can enter keeper 124 when aligned therewith. When the flipper member 96 ejects an empty core and moves to its outer position, the cord 108 engages bar 110 and is tensioned and moved longitudinally by the force of spring 98 which is strong enough to cause retraction of plunger 116 by compressing spring 112 thereby automatically unlocking the holder. Once the empty core is removed, the handle 40 can be used to pivot the holder to align the spindle and roller with the core in the lowest tissue roll 50 with this movement also moving the retaining flange 30 out of blocking engagement with lowest tissue roll 50 thereby enabling the lowest tissue roll to drop by gravity onto roller 86. The weight of the full tissue roll will move the flipper member 96 to its inner position by compressing spring 98. This movement of member 96 releases tension on the cord 108 so that the plunger 116 is biased toward locking position. When the holder is pivoted back to its normal position with the roller 86 horizontal, the plunger 116 will automatically engage keeper 124 thus locking the holder in position until all or substantially all of the tissue has been unwound from the core at which time the core is automatically ejected and the holder unlocks for another loading cycle. The spring 98 constantly urges the flipper member 96 against the tissue roll and biases it against the interior of wall 18 adjacent notch 102 to provide frictional resistance to rotation of the tissue roll thereby preventing waste of tissue which sometimes occurs when the tissue roll can freely rotate. As illustrated, the flipper member 96 is provided with U-shaped notches in order to straddle the roller 86 and sleeve 114 when moving between its inner position in FIG. 7 to its outer position in FIG. 6.

The plate 38 is provided with a curved protection shield 120 for covering the internal working mechanisms 96 to 116 and protect them from intentional damage and abuse which abuse may be applied from the front and bottom of the dipenser.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toilet tissue dispenser comprising a cabinet including a chute with four side walls spaced to receive for storing in vertical stacked end-on-end relation a plurality of rolls of paper, the rolls being mounted on a hollow core, each said roll having an axis that extends end-on-end with each other and the axes are substantially coaxial, and an angled plate having pivot means exteriorly extending from a central portion of a surface of the angled plate for rotatably mounting the angled plate from the cabinet, a handle exteriorly extending from another surface of the angled plate for manually swinging the angled plate about the pivot means, said pivot means being located at a lower end of one of the four side walls of the chute and the other surface of the angled plate being disposed generally coplanar with a chute wall adjacent said one wall, said chute including an opening in the top and in the bottom of the cabinet and the chute being sufficiently large to permit insertion and removal of said rolls, said angled plates including an interiorly extending end mounted spindle supported from a central portion of a surface back-to-back with said another surface containing the handle.

2. The invention of claim 1 wherein said chute includes a lid cover, means hingedly connecting the lid cover to a back wall of the chute at the top to close access to the chute and locking means securing the lid cover onto the cabinet.

3. The invention of claim 1 wherein the angled plate has a flanged retention plate extending between adjacent surfaces of the angled plate and disposed when the spindle is in a horizontal position to retain storage of rolls in displaced relation from the roll of paper mounted on the roller.

4. The invention of claim 1 together with positive locking means mounted on the angled plate and engaging one of the chute walls said locking means being released in response to absence of a tissue roll on the spindle to enable the angled plate to turn on the pivot means.

5. The invention of claim 1 together with tensioned flipper means mounted on said angled plate for ejecting a core of a toilet tissue roll away from the surface of the angled plate when the core is depleted of toilet tissues.

6. The invention of claim 5 wherein the tensioned flipper means includes leaf spring means biasing the flipper means to eject a core.

7. Storage and dispenser apparatus for tissue rolls having a hollow axial core comprising:

means defining a storage space wherein a plurality of said tissue rolls can be slidably stored in axially vertical position one on top of another;

a support and dispenser device pivotably mounted below said space and including a support member on which a tissue roll can rest and a roll holder spaced from said support member, said support member and roll holder each having a free end;

and means for pivotably moving said device between a roll-dispensing position wherein said support member and said roll holder are generally horizontally disposed with the roll holder beneath the support member and a roll-receiving position wherein said support member and said roll holder are generally vertically disposed with their free ends extending upwardly.

8. The storage and dispenser apparatus for tissue rolls as defined in claim 7 wherein said support and dispenser device includes an ejector plate for ejecting the hollow axial core of the tissue roll when the tissue has been unwound from the core.

9. The storage and dispenser apparatus as defined in claim 7 together with locking means to releasably retain the device in roll dispensing position.

10. The storage and dispenser apparatus as defined in claim 9 together with ejector means on the support and dispenser device for ejecting a core of a tissue roll when the tissue has been removed therefrom and means interconnecting the ejector means and locking means to move the locking means to unlocked position to enable pivotal movement of the support and dispenser device when the core of the tissue roll has been ejected from the roll holder.

* * * * *